US005345609A

United States Patent [19]

Fabry et al.

[11] Patent Number: 5,345,609

[45] Date of Patent: Sep. 13, 1994

[54] PROTECTIVE GLOVE HAVING CLOSED AND ISOLATED FLUID FILLED CELLS

[75] Inventors: John J. Fabry, Green Bay, Wis.; Koo Y. Kahng, Seoul, Rep. of Korea

[73] Assignee: Fabry Glove and Mitten Company, Green Bay, Wis.

[21] Appl. No.: 953,685

[22] Filed: Sep. 29, 1992

[51] Int. Cl.[5] ..... A41D 13/00

[52] U.S. Cl. ..... 2/20; 2/161.1

[58] Field of Search ..... 2/16, 18, 20, 19, 161 A, 2/161 R, 159, 163, 164, 2

[56] References Cited

U.S. PATENT DOCUMENTS

| | | | |
|---|---|---|---|
| 4,042,975 | 8/1977 | Elliot et al. . | |
| 4,095,294 | 6/1978 | Winterbottom . | |
| 4,319,412 | 3/1982 | Muller et al. . | |
| 4,547,919 | 10/1985 | Wang . | |
| 4,610,099 | 9/1986 | Signori . | |
| 4,745,635 | 5/1988 | Kinnear | 2/161 R |
| 4,763,426 | 8/1988 | Polus et al. . | |
| 4,864,660 | 9/1989 | Sawyer . | |
| 4,887,367 | 12/1989 | Mackness et al. . | |
| 5,155,864 | 10/1992 | Walker et al. | 2/161 A X |

FOREIGN PATENT DOCUMENTS

| | | | |
|---|---|---|---|
| 3326085 | 4/1985 | Fed. Rep. of Germany | 2/16 |
| 2638615 | 5/1990 | France | 2/161 A |
| 1667823 | 8/1991 | U.S.S.R. | 2/16 |
| 2237726 | 5/1991 | United Kingdom | 2/159 |

*Primary Examiner*—Clifford D. Crowder
*Assistant Examiner*—Larry D. Worrell, Jr.
*Attorney, Agent, or Firm*—Foley & Lardner

[57] ABSTRACT

A protective glove includes a glove body having at least one pocket with one or more hollow, shock-absorbing cells disposed therein. Each cell comprises a thin, flexible peripheral wall and an open interior space, which interior space contains a fluid under pressure sufficient so that the cell deforms upon impact of an object against the cell and cushions the hand of the wearer from the impact. The invention thereby provides a protective glove which is lightweight, simple in design, attractive in appearance and effective to protect the wearer's hand from blows or impacts.

9 Claims, 4 Drawing Sheets

PROTECTIVE GLOVE HAVING CLOSED AND ISOLATED FLUID FILLED CELLS

FIELD OF THE INVENTION

This invention relates to an improved protective glove, more particularly to a glove that provides protective cushioning for the back of the hand.

BACKGROUND OF THE INVENTION

Protective gloves, especially sports gloves, are well known and commonly used to protect an athlete's hands from injury. In baseball, racquetball or squash, a player should have sufficient hand protection to minimize fractures, bruises or soreness caused by the ball or by impact with other hard surfaces. In addition, such hand protection should maintain the flexibility for proper handling of a bat or racquet. A commercially available baseball batting glove made by Mizuno Corporation has foam padding over the back of the hand and on the forefinger, index finger and ring finger to provide protection during batting. The pinky finger is free of padding to allow the batter to better grip the bat.

A variety of materials have been used as protective padding in gloves. Sawyer U.S. Pat. No. 4,864,660 issued Sep. 12, 1989 provides a front glove portion joined to a back glove portion, and a protective package affixed to the back glove portion. The protective package comprises one or more flexible materials such as leather, textile, plastic or foam and may include a flexible plastic substrate between a multi-dimensional stretchable material and the back of the glove. In Elliot et al. U.S. Pat. No. 4,042,975 issued Aug. 23, 1977, a pair of protective plates conforming to the curved configuration of a batter's hands are releasably secured to the back of a glove.

Inflatable footwear is widely known, as shown in U.S. Pat. No. 4,319,412 issued Mar. 16, 1982 to Muller, et al, U.S. Pat. No. 4,610,099 issued Sep. 9, 1986 to Signori, U.S. Pat. No. 4,763,426 issued Aug. 16, 1988 to Polus, et al and U.S. Pat. No. 4,887,367 issued Dec. 19, 1989 to Mackness, et al. However, as to gloves, air padding has generally only been used in boxing gloves. U.S. Pat. No. 4,095,294 issued Jun. 20, 1978 to Winterbottom describes a pneumatic cushion in a boxing glove. Wang U.S. Pat. No. 4,547,919 issued Oct. 22, 1985 also discloses an inflatable boxing glove in which gas impervious sheets are sealed together to form a cushioning layer.

Thin-walled, air-filled plastic cellular materials have been previously used as packing materials, but have not been used as padding for gloves. Wang U.S. Pat. No. 4,547,919, issued Oct. 22, 1985, illustrates a variety of inflatable articles and thin-walled cellular materials.

Despite the development of various protective gloves, there still remains a need for a lightweight, economically produced sports glove providing adequate protection for the back of a wearer's hand without sacrificing flexibility and comfort.

SUMMARY OF THE INVENTION

A glove according to the invention includes a glove body having at least one pocket with one or more hollow, shock-absorbing cells disposed in the pocket. Each cell comprises a thin, flexible peripheral wall and an open interior space, which interior space contains a fluid under pressure sufficient so that the cell deforms upon impact of an object against the cell and cushions the hand of the wearer from the impact. Unlike conventional open or closed-cell foam materials having many small air-filled voids distributed in a plastic matrix, the cells according to the invention have a large open interior much greater in volume than the thin outer wall. The invention thereby provides a protective glove which is lightweight, simple in design, attractive in appearance and effective to protect the wearer's hand from blows or impacts.

According to one aspect of the invention, an array of spaced, air-filled plastic bubbles or cells are disposed in a closed pocket on the back of the glove to provide protection for the back of the hand. Each bubble is sealed. In another embodiment, a single cell inflatable bladder or balloon is provided over the back of the hand. With either embodiment, a small pump disposed in the glove body may be used to pressurize the cell(s), and a release valve permits deflation of the cell(s). The resiliency and deformability of the fluid-filled cell within the glove protects the hand from abrasion and impact, yet is flexible enough to allow the wearer to readily handle an implement such as a baseball bat.

BRIEF DESCRIPTION OF THE DRAWING

The invention will be described with reference to the appended drawing, wherein like numerals denote like elements, and.

DETAILED DESCRIPTION OF PREFERRED EMBODIMENTS

Figure 1:
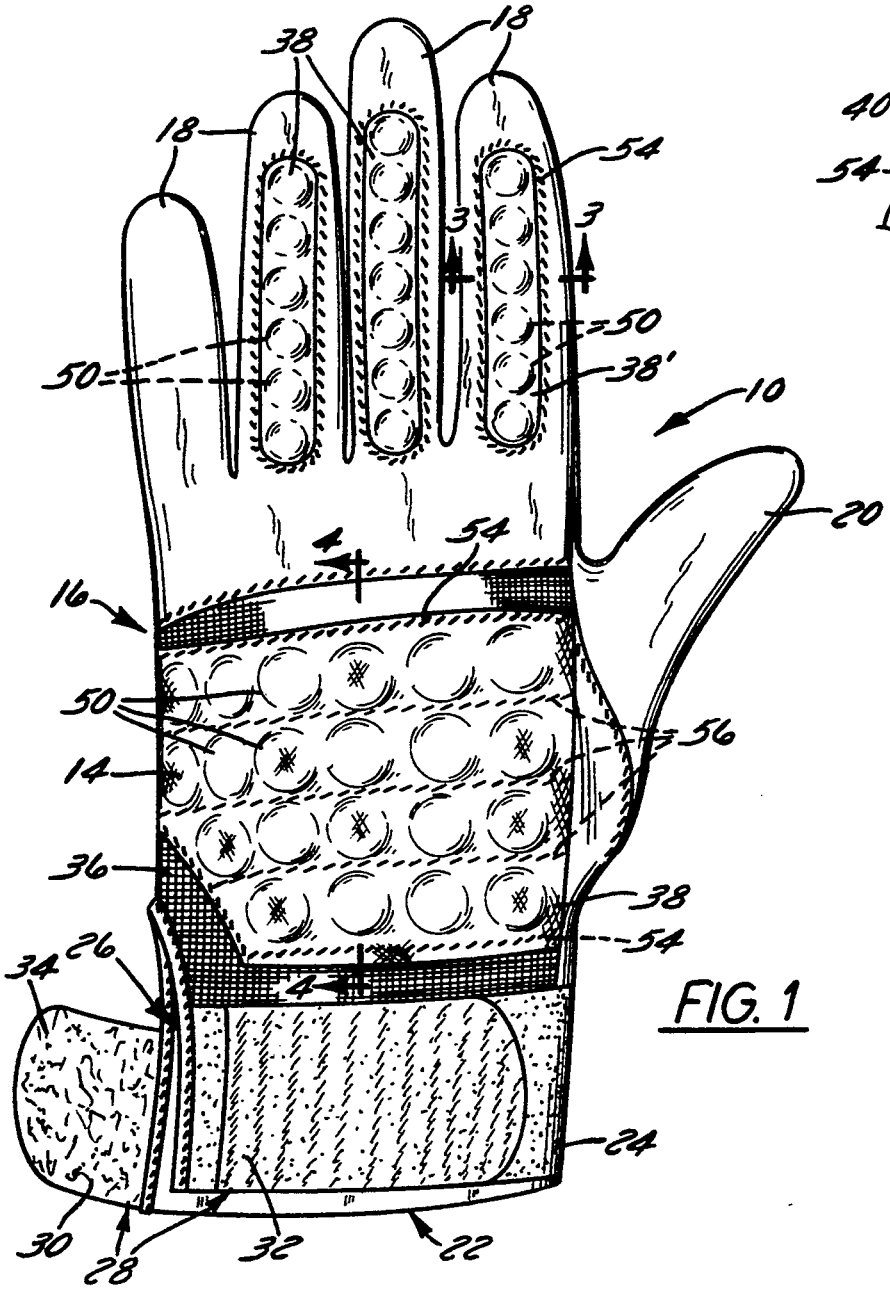
FIG. 1 is a rear plan view of the glove according to the invention.

FIGS. 1 through 4 illustrate a protective, left-handed glove 10 in accordance with the invention. While protective glove 10 has a preferred utility as a baseball batting glove, it is understood that the invention has a wide range of applications for use in active sports and industrial job activities where it is desirable to protect the back of the hand against impact or abrasion.

Protective glove 10 generally comprises a front or palm-covering portion 12 and a cushioned back portion 14 overlying the back of a wearer's hand. Front portion 12 and back portion 14 are configured and sewn together in face-to-face relationship to define a flexible glove body 16 in general conformity with the user's hand. Glove body 16 includes full finger portions 18 and a full thumb portion 20. Glove body 16 further defines a rearwardly disposed wrist opening 22 surrounded by a laterally extending wrist cuff 24 having a forwardly extending side vent 26 to enable the glove to fit different-sized hands.

Glove 10 preferably includes a releasable contact fastener 28 which acts as a means for selectively releasably securing glove to the wearer's hand. Releasable fastener 28 includes a tab 30 attached to one edge of side vent 26 and a base element 32 secured opposite tab 30 on cuff 24. In the illustrated embodiment, base element 32 comprises a piece of hook tape sewn to cuff 24, and the under surface of tab 30 is made of fibrous pile material 34 so that releasable fastener 28 comprises a typical hook and loop closure commonly known as a Velcro fastener. Other conventional fasteners such as snaps, buttons or the like could also be used.

Glove body 16 is generally made of conventional fabric or material such as leather, artificial (simulated) leather, deerskin, doeskin, calfskin, steer hide, nylon, nylon-acrylic, polyurethane-coated nylon, neoprene and terrycloth, among others. In the preferred embodiment, palm-covering portion 12 and tab 30 are made of leather, while finger portions 18 and thumb portion 20 are made of a leather/nylon combination, and back portion 14 and cuff 24 include nylon or nylon-like materials.

Cushioned back portion 14 has a structure specially adapted for the purposes of the present invention. Inner and outer panels 36 and 38, respectively, made of elastic fabric cooperate to form a closed pocket for a resilient, protective cellular material 40 which serves as a protective padding on glove. As will be appreciated, cellular material 40 must exhibit sufficient firmness to protect the back of the hand from shocks or abrasions, but should have sufficient flexibility to permit the wearer to effectively grasp and use an object, such as a baseball bat, while wearing the glove. A conventional bubble packaging material may be used as cellular material 40, although the bubbles should be strong enough to not pop during use. To provide effective protection, each cell or bubble preferably has an average thickness of at least about $\frac{1}{8}$ inch.

Referring to FIG. 1, inner elastic panel 36 is substantially rectangular in contour and extends from cuff 24 over most of the length of back portion 14, terminating near the wearer's knuckles. Inner panel 36 also extends substantially over the entire width of the back side of a wearer's hand and provides glove 10 with an inner lining stretchable in either direction to enhance the fit of the glove.

Figure 4:
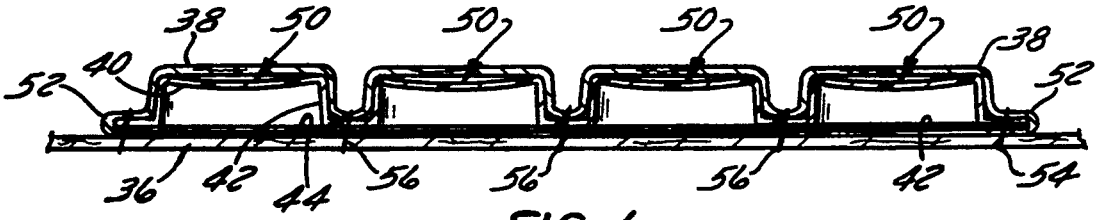
FIG. 4 is a sectional view taken along line 4—4 on FIG. 1.
Figure 2:
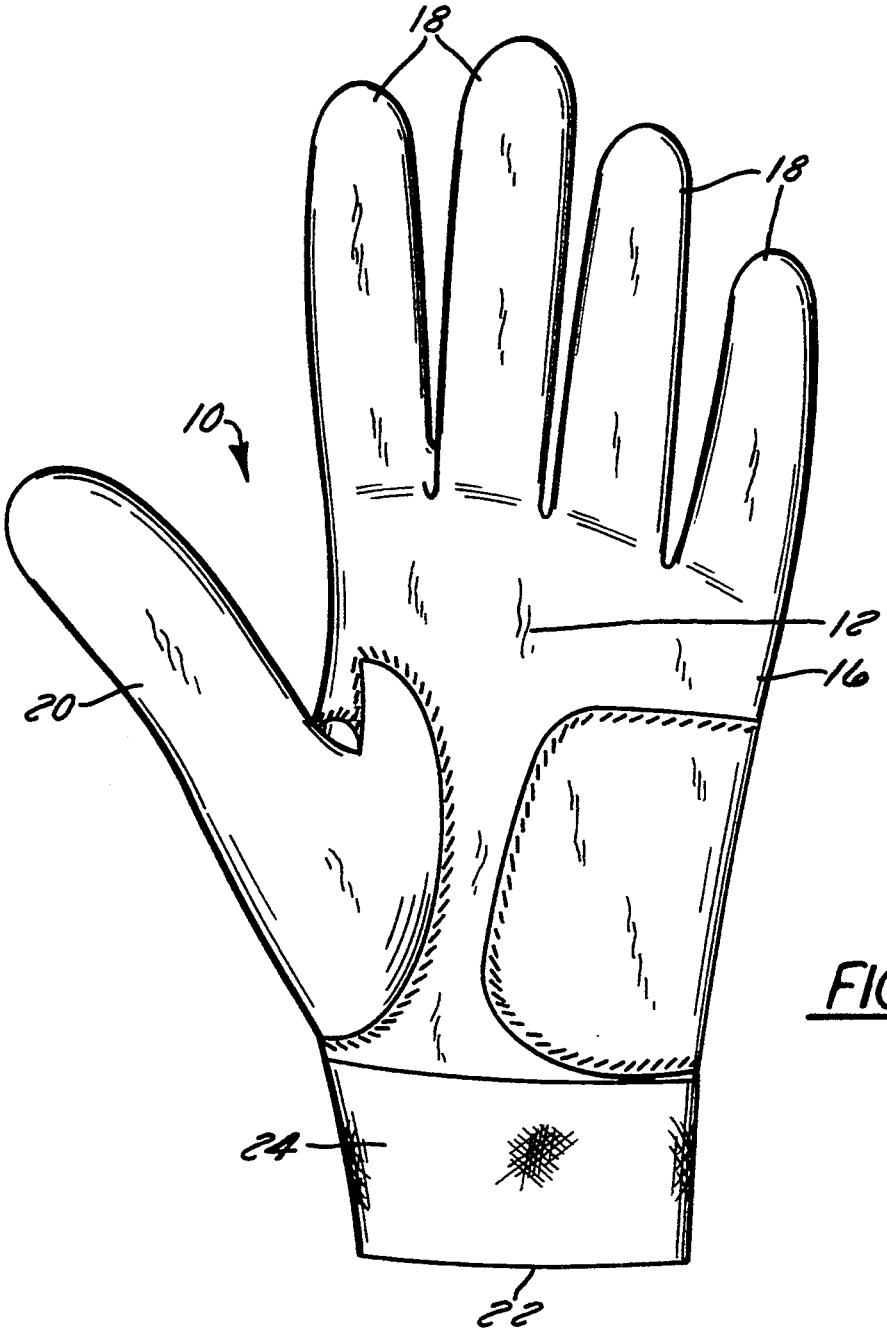
FIG. 2 is a front plan view of the glove shown in FIG. 1.

In accordance with the present invention, cellular material 40 is generally rectangular in shape and is disposed adjacent the exterior of inner panel 36 covering a major portion thereof. As best seen in FIG. 4, cellular material 40 preferably comprises a deformable array of air-filled plastic cells. A first thin plastic sheet 42 and a second thin plastic sheet 44 are joined together to form a series or array of equally spaced, generally cylindrical cells 50. Each cell 50 is substantially filled with a compressible fluid, preferably air, to provide a cushioning element.

Cellular material 40 is extremely lightweight, and has a preferred width of 3.5 to 4.5 inches and a preferred length of 2 to 3 inches depending upon the size of the wearer's hand. In the illustrated embodiment, each cell 50 is approximately 0.25–1.0 inch in diameter, 0.1 to 0.5 inch in height and is spaced from each other cell by a distance of about 0.1 to 0.2 inch. Cells 50 are preferably disposed relative to inner panel 36 in a series of four aligned rows, preferably of at least three cells each, running widthwise of a hand across the back of glove 10 to present a generally regular cushioning pattern. Such parameters and arrangement have been found advantageous because hand protection is provided without rendering the glove excessively bulky or inflexible.

The number and dimensions of cells 50 are not critical so long as cells 50 collectively provide sufficient resilience to absorb shocks and sufficient coverage for the back of the hand. Cellular material 40 may, for example, be replaced by four elongated air-filled cells or bladders each spanning the back of the hand in place of the widthwise rows of cells shown in FIG. 1. Plastic sheets 42, 44, or their equivalent, should have sufficient strength so that cells 50 do not pop during use. In the illustrated embodiment, each sheet 42, 44 has a thickness less than about 0.05 inch, generally less than about 0.01 inch.

Outer elastic panel 38 holds cellular material 40 snugly in position. Outer panel 38 is cut in substantially the same shape as cellular material 40 and is superposed therewith so that its edges are curled around and under the edges of cellular material 40 as shown at 52 in FIG. 4. Outer panel 38 is secured about its periphery to edges of cellular material 40 and inner panel 36 by stitching 54. A trio of generally parallel auxiliary seams 56 running widthwise of glove 10 also bind together inner and outer panels 36, 38 and cellular material 40. Auxiliary seams 56 are located in between the rows of cells 50 and serve to stretch outer panel 38 over cells 50.

Figure 3:
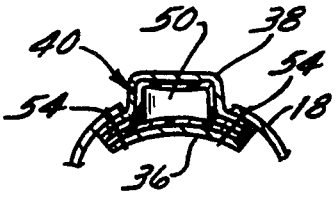
FIG. 3 is a sectional view taken along line 3—3 on FIG. 1.

In a similar manner best seen in FIG. 3, the back side of one or more of finger portions 18 may also be provided with protective padding in a formed pocket. In the preferred embodiment, finger portions 18 for the first three fingers each include an inner elastic panel 36' a cellular material 40' and an outer elastic panel 38' all of which are stitched together at 54' to finger portion 18. Cellular material 40' comprises a singular row of generally cylindrical air-filled cells 50' which are smaller in diameter and more closely spaced than cells 50 to cover substantially the rearward length of each of finger portions 18 for the first three fingers.

Figure 5:
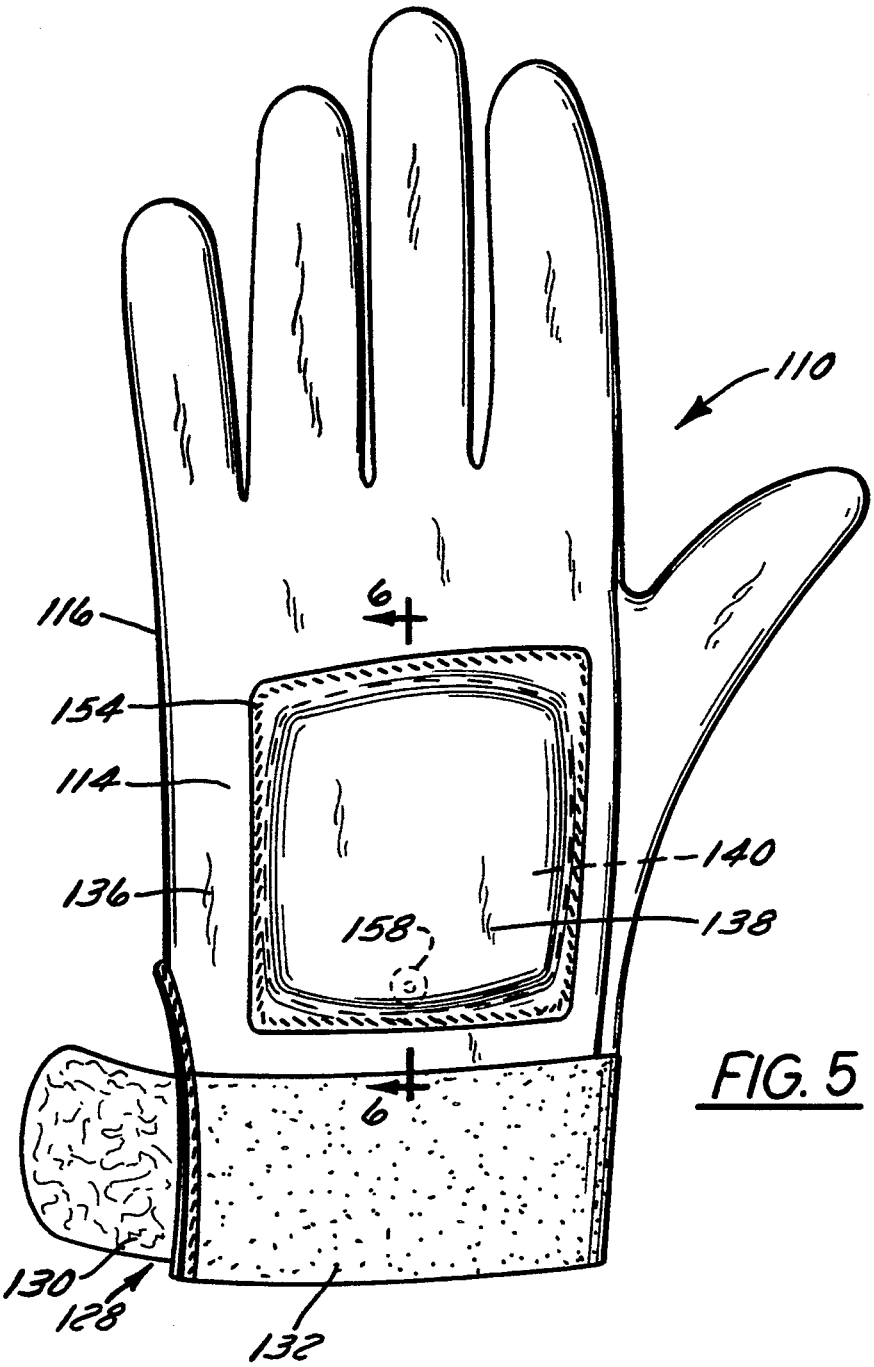
FIG. 5 is a rear plan view of a glove according to an alternative embodiment of the invention.
Figure 6:
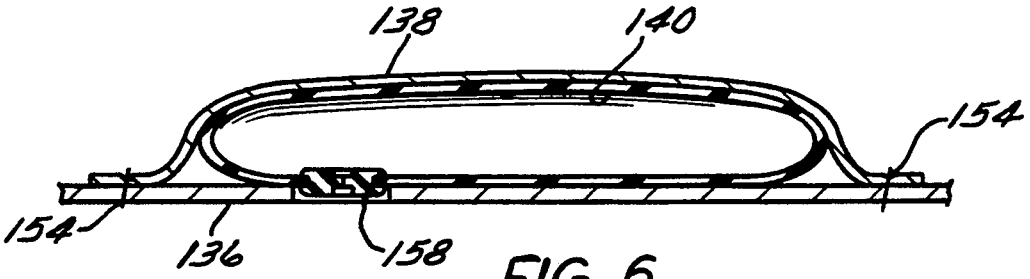
FIG. 6 is a sectional view taken along line 6—6 of FIG. 5.

FIGS. 5 and 6 illustrate a further embodiment of the invention. A protective glove 110 comprises a glove body 116 having a cushioned back portion 114. A closure device 128, including a tab 130 and a base element 132 for releasably securing glove 110 on the wrist of a wearer, is substantially as described in the previous embodiment. Inner and outer elastic panels 136 and 138, respectively, cooperate to form a closed pocket for a cellular material 140 which serves as protective padding. Cellular material 140 is preferably a deformable, single cell bladder or balloon made of rubber or plastic having a conventional needle valve 158 projecting through the pocket and inner panel 136 and accessible from inside glove 110 for inflating the bladder. A conventional hand pump may be used to inflate bladder 140, or a miniature pump actuated by repeated pressing may be sewn into the glove next to bladder 140 in the manner described in connection with FIGS. 7 and 8 below. As seen in FIG. 6, bladder 140 is disposed adjacent the exterior of inner panel 136 and is retained in place by outer elastic panel 138 which completely covers bladder 140 and is secured only about its periphery to inner panel 136 by stitching 154.

Figure 7:
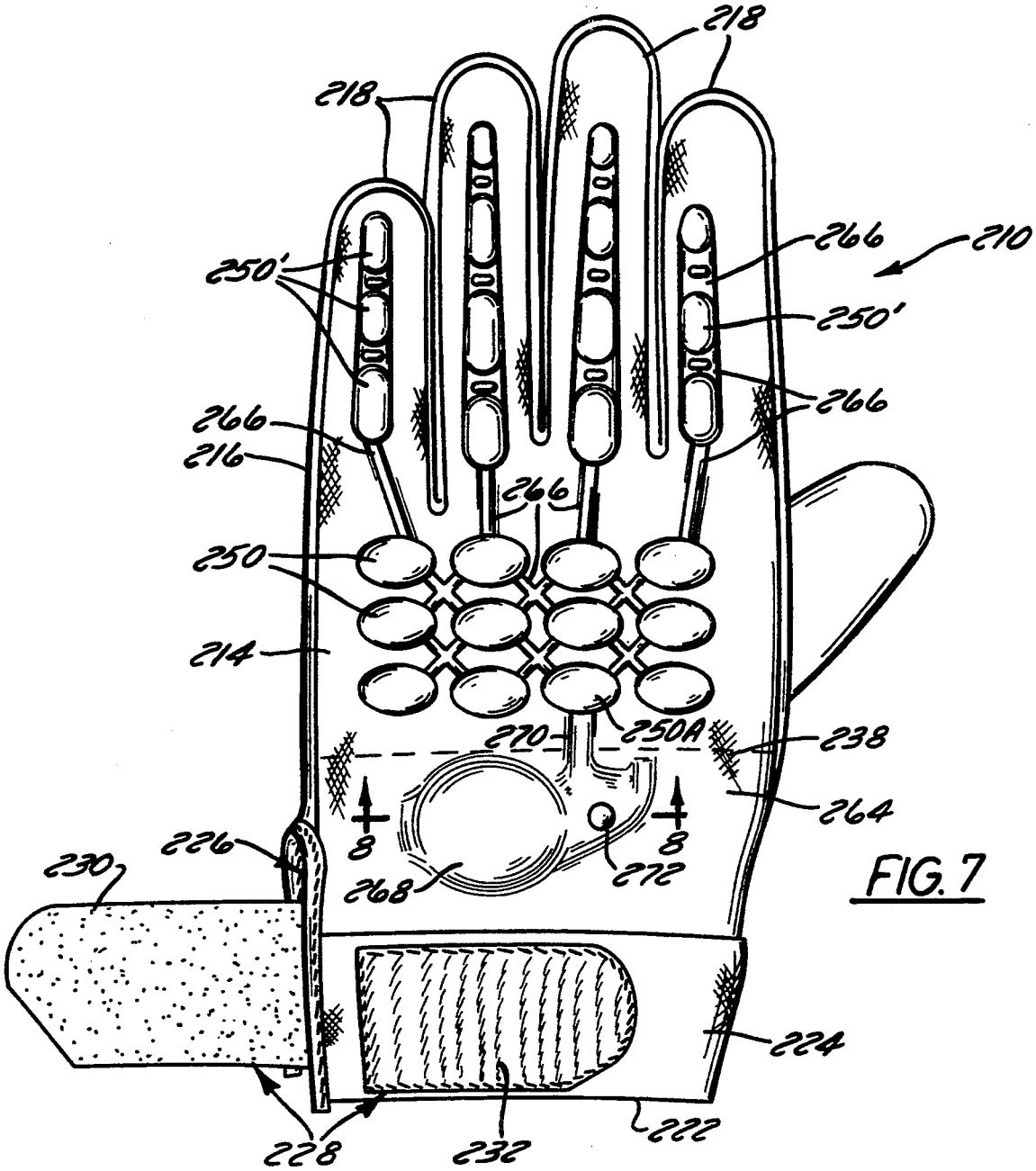
FIG. 7 is a rear plan view of a glove according to a further alternative embodiment of the invention.
Figure 8:
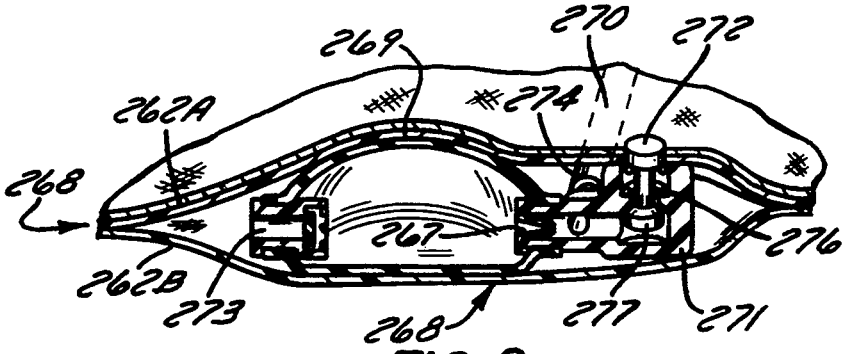
FIG. 8 is a sectional view taken generally along line 8—8 of FIG. 7.

FIGS. 7 and 8 illustrate a further embodiment of the invention. A protective glove 210 comprises a glove body 216 including finger portions 218 and having a cushioned back portion 214. Glove body 216 further defines a rearwardly disposed wrist opening 222 surrounded by a laterally extending wrist cuff 224 having a forwardly extending side vent 226 to enable the glove to fit different sized hands. A closure device 228, including a tab 230 and a base element 232 for releasably securing glove 210 on the wrist of a wearer, is substantially as described in the previous embodiment.

Cellular material 240 includes a flat plastic sheet 262 spanning the entire back portion 214 and the back part of fingers 218, and a series of rounded, bubble-shaped cells 250 protruding from sheet 262. Cells 250 are connected with one another by thin, tubular air passages 266 to form a cell network. Cells 250 and passages 266 may be fabricated by laminating a first sheet of plastic having recesses corresponding to the shape of cells 250 and passages 266 onto a second, flat sheet of plastic, and then bonding the sheets together by means of heat, an adhesive, or the like to form a double sheet 262 as shown.

Cells 250 are preferably arranged in three aligned rows running widthwise across the back of glove 210 substantially covering the back of the hand. Additional cells 250' are also arranged in singular rows along the backs of finger portions 218. An outer fabric panel 238 covers sheet 262 and cells 250. Sheet 262 is sewn directly to the glove body around its peripheral edges.

At a rear portion 264 of sheet 262, below the widthwise dashed line in FIG. 7, the two sheets making up sheet 262 are left unbonded, providing a top plastic sheet 262A and a bottom plastic sheet 262B. A miniature, manually-operated pump 268 is disposed in the pocket formed between sheets 262A, 262B. Pump 268 is connected to the network of cells 250 by an inlet/outlet passage 270 opening at the edge of rear portion 264. Once pump 268 is in place, sheets 262A, 262B are sewn around their peripheral edges to fabric covering 238.

Pump 268, which may be of any commercially available type, includes a rubber bulb 269 coupled to a plastic miniature valve housing 271 at one end and to a one-way inlet valve plug 273 at the other. Housing 271 includes a spring-loaded release button 272 that the wearer presses in order to deflate cells 250. Button 272 conveniently protrudes through plastic sheet 262A and fabric covering 238 so that it is accessible from the outside of the glove and provides an opening for air to pass through during inflation or deflation. Button 272 has a plunger 277 mounted at its lower end that is biased in a closed position against an internal step on housing 271 by a spring 276. Pressing button 272 permits air to escape from the cell network through passage 270 past button 272.

Passage 270 preferably contains a small, rigid plastic tube 274 that is press-fitted into an air inlet/outlet opening 275 of housing 271. Tube 274 helps ensure that air is pumped directly into the cell network without leaking, and that a high pressure can be maintained when the cells are fully inflated. Tube 274 extends between sheets 264A, 264B, which may be bonded to the outer surface of tube 274, through to an inlet cell 250A. Cell 250A communicates with all of the other cells 250, 250' by means of the passages 266, so that the cell network remains at a uniform pressure. A one-way valve plug 267 prevents the pressurized air within the cell network from escaping from valve housing 271. Pump 268 must have a sufficiently durable valve mechanism to maintain elevated pressures within the cells 250 for extended periods, i.e., while the glove is worn.

Glove 210 is used as follows. The user first puts on the glove in the usual manner. Repeated pressing of bulb 269 causes air to flow through inlet 270 into the network of cells 250 and passages 266. The pressure within cells 250 increases, and the cells become stiffer, providing protection against shocks. In the batting glove shown, the inflated cells protect the batters hand if it is hit by a ball. The wearer can select the amount of stiffness desired by varying the number of times bulb 269 is pressed and released; pressing the bulb from about 3–7 times is typical. After batting, the wearer deflates cells 250 by pressing button 272.

A glove 10, 110, or 210 according to the invention effectively protects the wearer from shocks or abrasions which may cause injury, yet is lightweight, permits the wearer's wrist and fingers to move freely, and can flex sufficiently to permit the user to grasp a bat or racquet. In glove 10, the array of spaced air cells provides additional flexibility and insures that, if one cell is punctured, the remaining cells will still provide sufficient protection. The inflatable embodiment of the invention permits the wearer to adjust the internal pressure within the protective cell or bladder to provide the desired amount of protection. This contrasts with a variety of inflatable footwear now available, wherein the footwear is inflated to provide a better fit.

It will be understood that the above description is of preferred exemplary embodiments of the invention and, that the invention is not limited to the specific forms shown. For example, differently shaped cells may be employed over greater or lesser surface areas on the glove. Likewise, the cells could be filled with compressible liquids or gases other than air to provide the desired cushioning effect. These and other modifications may be made in the described invention without departing from the scope thereof as expressed in the appended claims.

We claim:

1. A glove for protecting the back of a hand from abrasion and impact, the glove comprising:

a flexible glove body having a front portion for covering a palm of a hand, a back portion for overlying a back of a hand and a wrist cuff defining a wrist opening for receiving a hand, the back portion including a first panel and a second panel, and means for joining the first panel and the second panel together to form at least one pocket on the back portion; and an array of hollow, sealed, shock-absorbing cells disposed in the pocket, each cell comprising a thin, flexible peripheral wall and an open interior space, which interior space is substantially filled with a fluid so that each cell deforms upon impact of an object against the cell and cushions the hand of the wearer from the impact, and each cell is closed and isolated from the other cells, such that rupture of one cell does not affect the shock absorbing characteristics of the other cells.

2. The glove of claim 1, wherein the glove has a plurality of the shock absorbing cells located on the back of the glove, and at least one row of the shock-absorbing cells on at least one finger of the glove, each row of cells being disposed in a separate pocket.

3. The glove of claim 1, wherein the shock-absorbing cells are disposed in rows and columns in spaced positions over the back of the hand.

4. The glove of claim 1, wherein the wall of each cell is made of a material selected from the group consisting of plastic and rubber, and the cells are filled with air.

5. The glove of claim 1, wherein the cells are made of plastic, air-filled bubbles disposed on a plastic sheet.

6. The glove of claim 1, wherein the front of the glove is free of the shock-absorbing cells.

7. The glove of claim 5, wherein the front of the glove is free of the shock-absorbing cells.

8. The glove of claim 7, wherein each cell has a diameter in the range of about 0.25 to 1 inch and a height of from about 0.1 to 0.5 inch.

9. The glove of claim 8, wherein the cells are spaced from each other by a distance of about 0.1 to 0.2 inch.

* * * * *